United States Patent [19]

Gebhart

[11] 4,393,856

[45] Jul. 19, 1983

[54] APPARATUS FOR MILLING BUILDING BLOCKS

[76] Inventor: Siegfried Gebhart, Tobelstadel, D-7971 Aitrach-Aichstetten, Fed. Rep. of Germany

[21] Appl. No.: 240,535

[22] Filed: Mar. 4, 1981

[30] Foreign Application Priority Data

Mar. 13, 1980 [DE] Fed. Rep. of Germany ..... 3009615

[51] Int. Cl.[3] ..... B28D 1/18

[52] U.S. Cl. ..... 125/3; 51/80 A; 125/26

[58] Field of Search ..... 125/3, 26; 198/403, 198/461; 51/80 A, 80 R

[56] References Cited

U.S. PATENT DOCUMENTS

| | | | |
|---|---|---|---|
| 2,958,163 | 11/1960 | Cammerzell | 125/26 |
| 3,575,155 | 4/1971 | Byrd | 125/3 |
| 3,895,722 | 7/1975 | Pluntz | 198/403 |
| 3,918,210 | 11/1975 | Mori | 125/3 |
| 4,164,279 | 8/1979 | Dubuit | 198/461 |
| 4,165,006 | 8/1979 | Brusa | 198/403 |

FOREIGN PATENT DOCUMENTS

| | | | |
|---|---|---|---|
| 468790 | 5/1973 | U.S.S.R. | 125/3 |

*Primary Examiner*—Harold D. Whitehead
*Attorney, Agent, or Firm*—Benoit Law Corporation

[57] ABSTRACT

Apparatus for milling building blocks comprise a first arrangement for milling said blocks at a first side thereof, and a second arrangement for milling said blocks at a second side thereof. Apparatus are located between the mentioned first and second arrangements for accelerating the blocks after their milling at the first side. Apparatus further are located between one of the mentioned first and second arrangements and the accelerating apparatus, for turning the blocks for their milling at a second side thereof by 180° about an axis extending parallel to the direction of transportation of the blocks.

16 Claims, 2 Drawing Figures

APPARATUS FOR MILLING BUILDING BLOCKS

BACKGROUND OF THE INVENTION

Field of the Invention

The invention concerns apparatus for cutting or milling bricks or building blocks; particularly for a horizontal or face milling of two opposing planes of hollow building blocks.

For the purpose of maintaining specific dimensions and for the provision of grooves, bricks, in particular hollow building blocks made of light concrete or pumice, have to be face-milled on their lower or upper planes.

According to prior-art methods the bricks to be milled are transported by means of a conveyor belt. Two milling shafts which contain the milling blades are thereby mounted above each other on a frame and the bricks are sent through the two cutters, whereby the upper and lower planes are simultaneously cut to the desired dimensions.

This prior-art method has the disadvantage that the grooves on the upper and the lower planes are of different depths. The total height of the stone is predetermined by adjusting the distance between the two milling shafts. However, due to the different density of the concrete in the brick (in the lower area the density is higher) the brick is deflected from the milling shafts to some extent, thus resulting in a difference in the depth of the grooves. Furthermore, it is disadvantageous that such arrangement works imprecise with respect to the total height of the brick and is susceptible to breakdowns, since the milling shafts are capable of flexing.

SUMMARY OF THE INVENTION

It is an object of the subject invention to provide an apparatus of the initially described type, with which building blocks or bricks may be cut or milled with great precision and relatively little effort.

From a first aspect thereof, the subject invention resides in apparatus for milling building blocks at opposite first and second sides in two steps comprising, in combination, first means for milling the blocks at the first side thereof in a first one of said steps, second means for milling the blocks at the second side thereof in the second one of said two steps, third means located between the first and second means for accelerating the blocks in a direction of transportation of the blocks after their milling at the first side, and fourth means located between one of the first and second means and the third means for turning the blocks 180° for their milling at a second side thereof. The fourth means include a box having opposite open ends, with one end providing an entrance for blocks and the other open end an exit for the blocks, and means including a frame for mounting the box for rotation by said 180° to about an axis of rotation parallel to the direction of transportation of the blocks.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
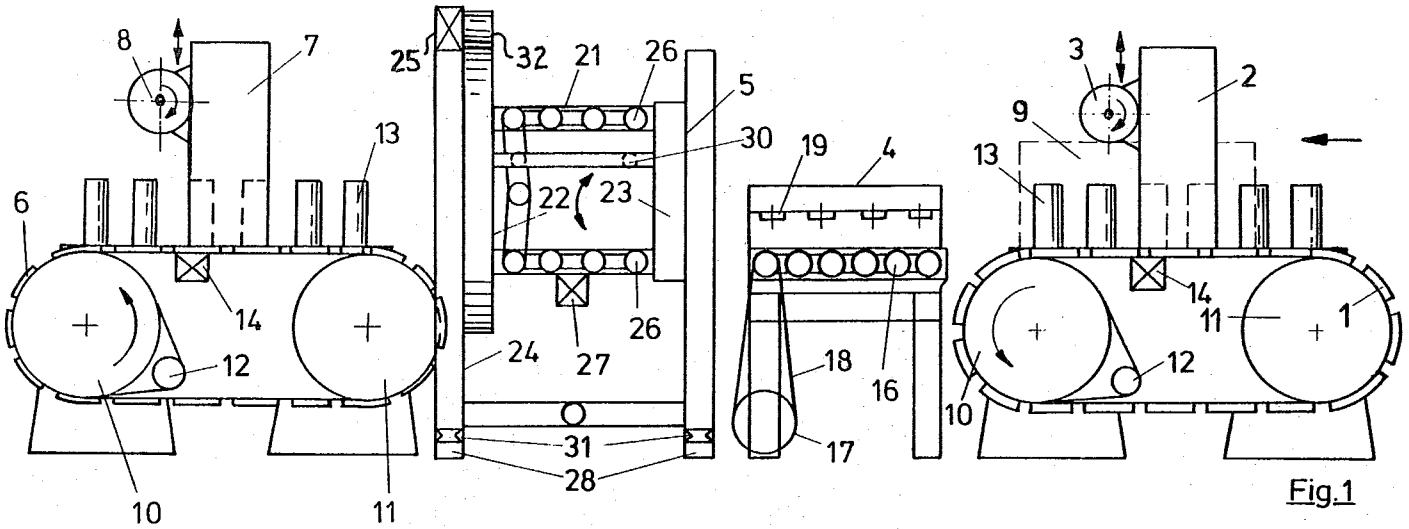
FIG. 1 is a side view of a system for milling building blocks.
Figure 2:
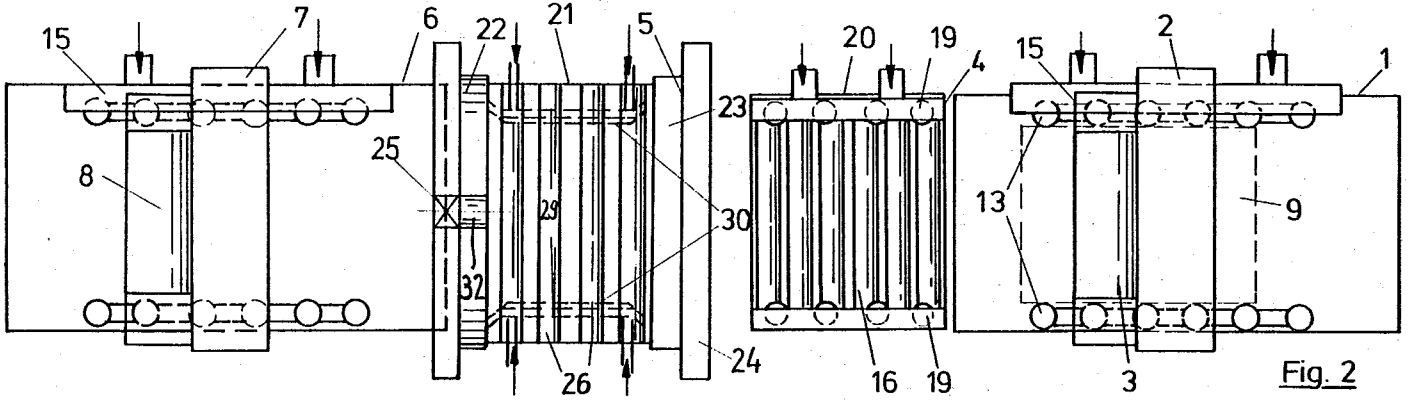
FIG. 2 is a top view of the system of FIG. 1.

The system shown in the drawings has a first conveyor belt 1 above which a milling shaft 3 containing milling blades is mounted on a frame 2. The conveyor belt 1 is followed in the direction of transportation by an acceleration apparatus 4, which itself is followed by a turning apparatus 5. This is subsequently linked to a second conveyor belt 6 above which a milling shaft 8 containing milling blades is also mounted on a frame 7.

The building blocks 9 to be processed, shown in FIG. 1 by dotted lines, are being transported on the apparatus in the direction of the arrow. The two conveyor belts 1 and 6 are plate conveyors, comprising plates which provide a stable support for the blocks 9. The two plate conveyors 1 and 6 are each made endless by means of two rollers 10 and 11. They are driven by means of a motor 12 and a V belt. Instead of a V belt, a gear drive may appropriately be used.

Above each of the conveyor belts 1 and 6 along the transport paths, several guidance rollers 13 are mounted. Their axes of rotation are vertical with respect to the plane of the conveyor belts. The guidance rollers 13 are being driven on one side by a motor 14, being interconnected via friction drives, gears or V belts in such a manner that the motor 14 is capable of driving all guidance rollers on one side simultaneously. The guidance rollers provide the blocks with lateral guidance for achieving a high precision of the resulting milling dimension.

The guidance rollers 13 on the other side are jointly mounted on a rail 15. The rail 15 is movable transversely to the direction of transportation of the blocks 9. In this manner, the conveyor path width may be adjusted to the required width of the blocks to be processed, thereby enabling the milling of blocks of different dimensions. The direction of rotation of the milling shafts 3 is selected so that the cutting or milling direction is identical to the direction of transportation. This will eliminate tearing of the block at the end of a milling operation.

After the block 9 has passed the blades of the milling shaft 3 on one side, that is after the upper side has been face milled or grooved accordingly, the block 9 arrives at the acceleration apparatus 4. The acceleration apparatus comprises several transportation rollers 16 mounted consecutively in the direction of transportation for accelerating the blocks in that direction of transportion. The transportation rollers 16 are jointly driven by a motor 17 via a V belt 18, with their rate of revolution chosen to be of such high value that compared to the speed of transportation of the block 9 on the conveyor 1, a significantly higher velocity results for the blocks 9 in the accelerator 4.

Several guidance rollers 19 mounted consecutively in the direction of transportation on both sides serve the lateral guidance of the blocks. The axes of rotation of the guidance rollers 19 are essentially vertical to the plane of transportation. The guidance rollers 19 are positioned jointly on one side in a girder 20 that is transversely movable relative to the direction of transportation and provides for a simple adjustment procedure.

The turning apparatus 5 that succeeds the acceleration apparatus 4 has a box 21 whose opposite ends are open. The front end or side forms an entrance, and the back side or end forms an exit, for the blocks. The box is rotatable by 180° about a horizontal axis extending parallel to the direction of the transportation. For this purpose, the box 21 has rotary tables and gate end plates 22 and 23 at its open sides. The rotary gate end plates 22 and 23 are mounted on a frame 24.

For turning the box 21, a turning motor 25 is employed, being connected to one of the gate end plates via a friction drive, gears, V belt or a similar device. The motor 25 thus turns the box 21 by 180° whenever a block 9 is located therein. In this manner, the lower unmilled side of the building block is turned upwards and thus can be milled also on the subsequent conveyor belt 6. The box is provided on the floor and ceiling with driven rollers 26 for continued block transportation. The rollers 26 are driven jointly by a motor 27 which is connected thereto via V belts and/or gears. The gate end plates 22 and 23 may be equipped with toothed rims (not shown) driven by means of pinions 32 rotated by the motor 25.

The frame 24 with box 21 is mounted on movable rails 28 and can be moved transversely to the direction of transportation. This movement takes place in dovetail guides 31 and may be effected with the aid of a crank drive.

In this manner the box 21 can be centered precisely relative to the conveyor belt 1 and the acceleration apparatus 4, in correspondence to the widths of the blocks 9. Thus the turning device 5 can always be adjusted in such a manner that the block will be arriving exactly in the middle of the turning device, since the blocks, after they have been turned by 180°, must enter the second transportation device 6 with the milling shaft 8 at a fixed reference point.

In order to provide the blocks in the box 21 with precise guidance, the interior of the box is equipped on both sides with guiding strips 29 which are adjustable transversely to the direction of transportation. In order to minimize friction, the guidance strips 29 may be covered with a low friction material 30.

After a block 9 has been turned in the box 21, it arrives at the conveyor belt 6 and consequently is milled on its other side by the blades of the milling shaft 8.

According to the invention, the upper and lower sides or planes of the building block are no longer cut during a simultaneous milling process. This function is now performed in two steps. In this manner, a very high milling precision can be achieved, since the blocks to be milled are guided precisely under the milling blades and are correspondingly supported on the transport conveyor. The new procedure thus results in greater accuracy with regard to precise maintenance of desired dimensions. In order to assure a regular passage of the blocks, an acceleration device 4 is preferably arranged in front of the turning device 5, since each block has to be turned individually.

A relatively unyielding contact surface for the blocks 9 is achieved by forming the conveyors 1 and 6 as plate conveyors.

A simple device for the acceleration track 4 comprises several basically horizontally placed and driven conveyor rollers 16 in consecutive order. In order to achieve satisfactory lateral guidance, the acceleration device is advantageously equipped with several guidance rollers 19 with essentially vertical axles arranged in consecutive order in the direction of the transportation.

The subject disclosure will suggest or render apparent to those skilled in the art various modifications and variations within the spirit and scope of the invention.

I claim:

1. Apparatus for milling building blocks at opposite first and second sides in two steps, comprising in combination:

first means for milling said blocks at said first side thereof in a first one of said steps;

second means for milling said blocks at said second side thereof in the second one of said two steps;

third means located between said first and second means for accelerating said blocks in a direction of transportation of the blocks after said milling at said first side; and fourth means located between one of said first and second means and said third means for turning said blocks by 180° for said milling at a second side thereof;

said fourth means including a box having opposite open ends, with one open end providing an entrance for blocks and the other open end an exit for the blocks, and means including a frame for mounting the box for rotation by said 180° about an axis of rotation parallel to said direction of transportation of the blocks.

2. Apparatus according to claim 1, wherein:

said first means include a first conveyor for said bricks and an adjustable first milling shaft with milling blades, mounted above said first conveyor belt; and said second means include a second conveyor for said bricks and an adjustable second milling shaft with milling blades.

3. Apparatus according to claim 2, wherein:

said first and second conveyors are plate conveyors.

4. Apparatus according to claim 2, wherein:

several guidance rollers having vertical axes of rotation relative to a conveyor plane are arranged along a milling path on both sides of each conveyor.

5. Apparatus according to claim 4, including:

means for driving at least the guidance rollers on one of said sides.

6. Apparatus according to claim 4, including:

means for adjusting at least the guidance rollers on one of said sides transversely to the direction of transportation of said blocks.

7. Apparatus according to claim 4, including:

means including a rail adjustable transversely to a direction of transportation of said blocks, for rotatably mounting said guidance rollers.

8. Apparatus according to claim 1 or 2, wherein:

said third means include several driven transport rollers arranged consecutively and essentially horizontally.

9. Apparatus according to claim 8, wherein:

said third means include several guidance rollers arranged bilaterally in consecutive order in a direction of transportation with essentially vertical axes of rotation.

10. Apparatus according to claim 9, wherein:

said guidance rollers are at least on one side jointly positioned on a girder that is adjustable transversely to the direction of transportation.

11. Apparatus according to claim 1, wherein:

said box has a floor and a ceiling provided with drivable rollers.

12. Apparatus according to claim 1 or 11, wherein:
said box has on both open ends rotary gate end plates mounted on the frame.

13. Apparatus according to claim 1 or 11, wherein:
one of said frame and said box is mounted on rails and transversely adjustable with respect to a direction of transportation of said blocks.

14. Apparatus according to claim 13, wherein:
said frame is connected to the rails by means of a dovetail guide.

15. Apparatus according to claim 1, including:
guidance strips adjustable transversely to a direction of transportation of the blocks and located on opposite sides of said box.

16. Apparatus according to claim 15, wherein:
said guidance strips are covered on the sides facing the blocks with a friction reducing material.

* * * * *